US009254024B2

(12) United States Patent
DeWitt

(10) Patent No.: US 9,254,024 B2
(45) Date of Patent: Feb. 9, 2016

(54) PURSE HAVING INTERCHANGEABLE INNER BAGS

(71) Applicant: Laura DeWitt, Frisco, TX (US)

(72) Inventor: Laura DeWitt, Frisco, TX (US)

( * ) Notice: Subject to any disclaimer, the term of this patent is extended or adjusted under 35 U.S.C. 154(b) by 275 days.

(21) Appl. No.: 13/905,967

(22) Filed: May 30, 2013

(65) Prior Publication Data

US 2014/0352858 A1 Dec. 4, 2014

(51) Int. Cl.

| | |
|---|---|
| ***A45C 13/02*** | (2006.01) |
| ***A45C 1/02*** | (2006.01) |
| ***A45C 13/30*** | (2006.01) |
| ***A45C 7/00*** | (2006.01) |

(52) U.S. Cl.

CPC . *A45C 13/02* (2013.01); *A45C 1/02* (2013.01); *A45C 7/005* (2013.01); *A45C 7/0045* (2013.01); *A45C 7/0054* (2013.01); *A45C 13/30* (2013.01); *A45C 2007/0004* (2013.01); *A45C 2200/10* (2013.01)

(58) Field of Classification Search

IPC ..... A45C 13/02,7/005, 7/0045, 7/0054, A45C 1/02, 13/30, 2007/004, 2200/10

See application file for complete search history.

(56) References Cited

U.S. PATENT DOCUMENTS

| | | | | | |
|---|---|---|---|---|---|
| 2,159,555 | A * | 5/1939 | Fulton | 453/54 |
| 2,303,560 | A * | 12/1942 | Knight | 29/261 |
| 2,764,201 | A * | 9/1956 | Whippo | 150/111 |
| 4,852,293 | A * | 8/1989 | Levine et al. | 43/54.1 |
| 5,285,833 | A * | 2/1994 | Haxby | 150/102 |
| 5,351,813 | A * | 10/1994 | Golovan | 220/483 |
| 5,779,033 | A * | 7/1998 | Roegner | 206/6.1 |
| 5,983,969 | A * | 11/1999 | Morgan | 150/104 |
| 6,129,210 | A * | 10/2000 | Rustemeyer et al. | 206/736 |
| 6,244,400 | B1 * | 6/2001 | Bowers | 190/110 |
| 6,296,094 | B1 * | 10/2001 | Knecht | 190/107 |
| 6,523,653 | B2 * | 2/2003 | Roegner | 190/109 |
| 7,798,323 | B1 * | 9/2010 | McCann et al. | 206/370 |
| 2002/0114539 | A1 * | 8/2002 | Strevey et al. | 383/13 |
| 2005/0016808 | A1 * | 1/2005 | Sapyta | 190/107 |
| 2006/0196744 | A1 * | 9/2006 | Greiner | 190/110 |
| 2006/0207697 | A1 * | 9/2006 | Greiner | 150/113 |
| 2007/0163689 | A1 * | 7/2007 | Pace et al. | 150/105 |
| 2009/0090442 | A1 * | 4/2009 | Surface et al. | 150/104 |

* cited by examiner

*Primary Examiner* — Tri Mai

(57) ABSTRACT

A purse having interchangeable inner bags includes an outer casing, a plurality of inner bags, and a shoulder strap. A first chosen bag and a second chosen bag of the plurality of inner bags are removably attached to the outer casing, where the outer casing encloses the first chosen bag and the second chosen bag. The shoulder strap is removably attached to the outer casing through a pair of connecting rings. Each of the plurality of inner bags includes a front transparent panel which opens up to the users when the outer casing is unfolded. The users can store items within each of the plurality of bags and access the stored items through a bag zipper. A back panel of the plurality of inner bags magnetically attached the first chosen bag and the second chosen bag with outer casing.

10 Claims, 18 Drawing Sheets

SECTION A-A
SCALE 1 : 1

PURSE HAVING INTERCHANGEABLE INNER BAGS

FIELD OF THE INVENTION

The present invention relates generally to a purse. More specifically, the present invention is a purse with interchangeable inner bags which can change into a cross over bag or a clutch bag.

BACKGROUND OF THE INVENTION

Handbags have their origin traced back to ancient ages. The ancient Egyptians used bags to carry their collected crops or seeds. In 14$^{th}$ century Europe, small bags became something that women would only carry for their makeup. However, when social status became prominent in the traditional society, the handbag design became more elaborate and new varieties of handbags were introduced. In the modern period, there are many different kinds of handbags that exist in the market with many different brands to choose from. Consumers purchase these commodities based on their needs and popularity of brands or styles. The purpose of handbags has changed from carrying seeds for farming to carrying anything that can be fitted. For example, women now usually carry their makeup, cell phone, keys, medicine, and other items which make their handbag become full or even heavy.

In the modern era, the primary use of the handbag is to provide convenient storage for items while also making a fashion statement. But in recent years handbags are overfilled with consumer products, such as cell phones, car keys, medicine, etc. Due to the unorganized storage within the handbags, users tend to carry more and more items within the handbags. These extra stored items can cause health problems due to the added weight. The user also has to spend more time sorting through the stored items to find the desired item. Today's society is extremely fashion and style conscious as designers only consider the uniqueness of their designs but neglect comfort. Women and men tend to carry too many items in their bags which weigh more than 10 percent of their bodyweight. This can cause improper body balance and interference with human motion. As a solution for these problems, manufactures tend to add more compartments and different configurations to the handbags so that the users can organize their belongings within their handbags.

The purpose of the present invention is to provide an easy way to carry items and have them placed in an easy to access fashion within interchangeable inner bags, where the interchangeable inner bags are enclosed by an outer cover. The present invention would allow the users to spend less time sorting through their handbags and carry less if they desire.

DETAIL DESCRIPTIONS OF THE INVENTION

All illustrations of the drawings are for the purpose of describing selected versions of the present invention and are not intended to limit the scope of the present invention.

Figure 1:
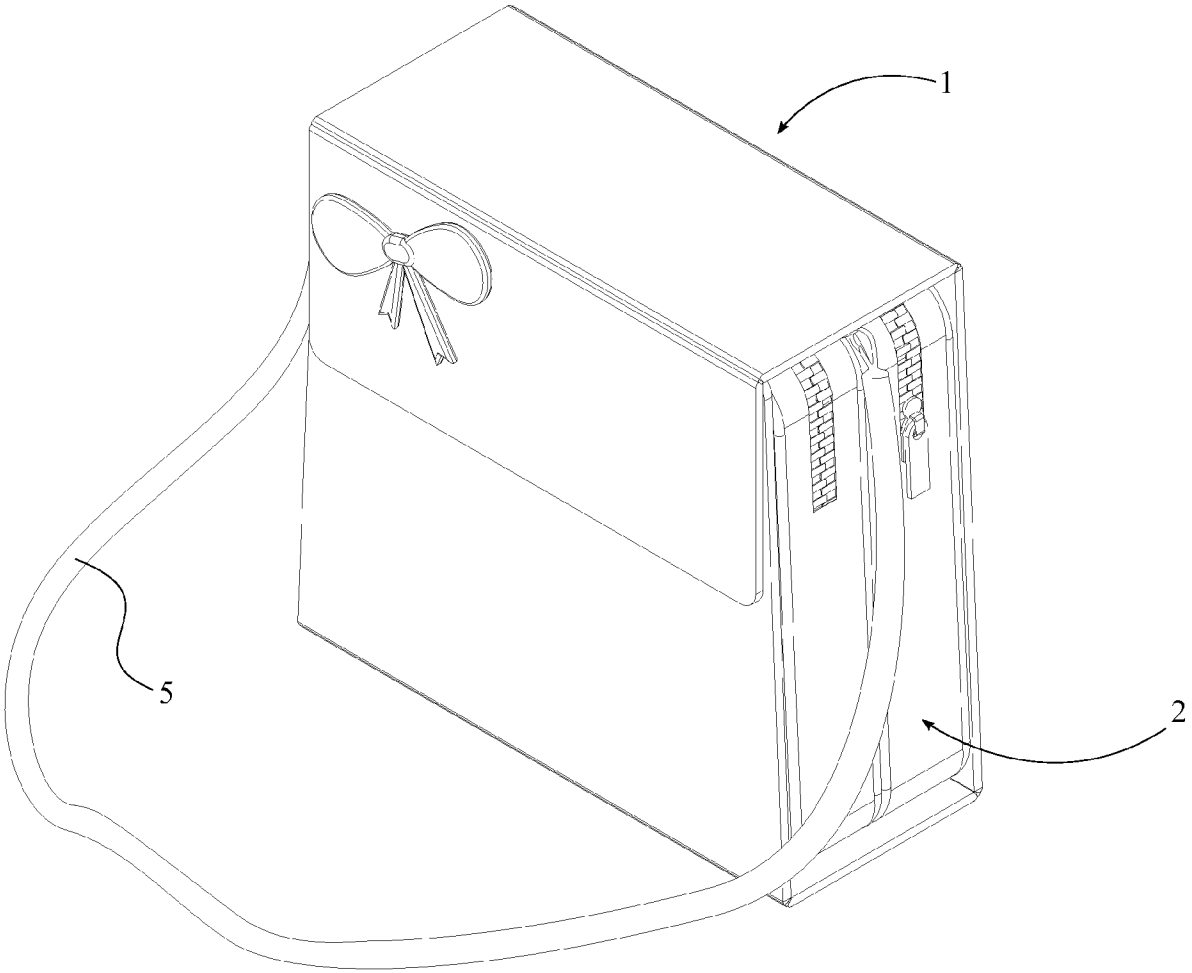
FIG. 1 is a perspective view of the present invention.
Figure 2:
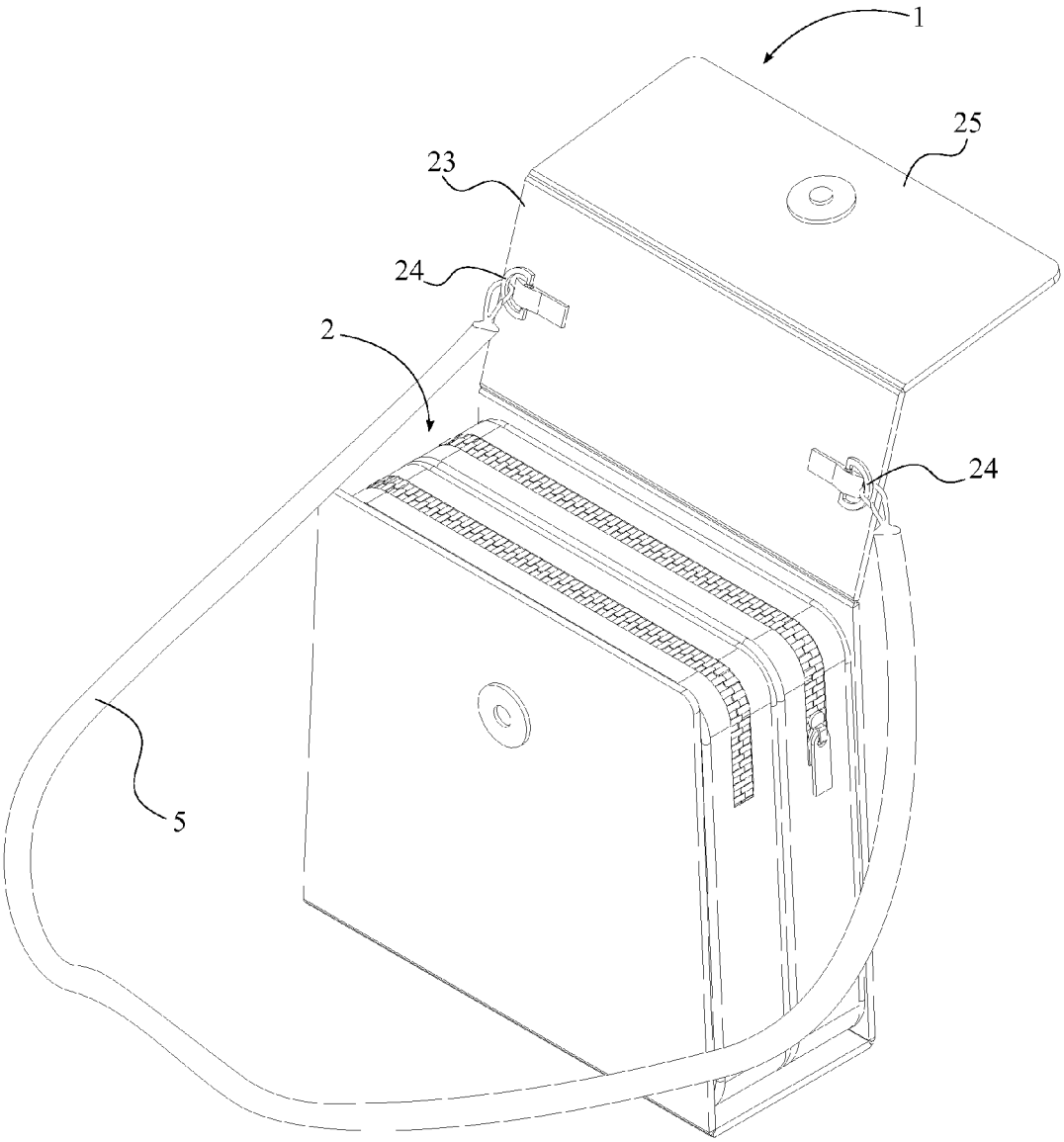
FIG. 2 is a perspective view of the present invention, wherein an outer casing is opened showing the inner bags.
Figure 3:
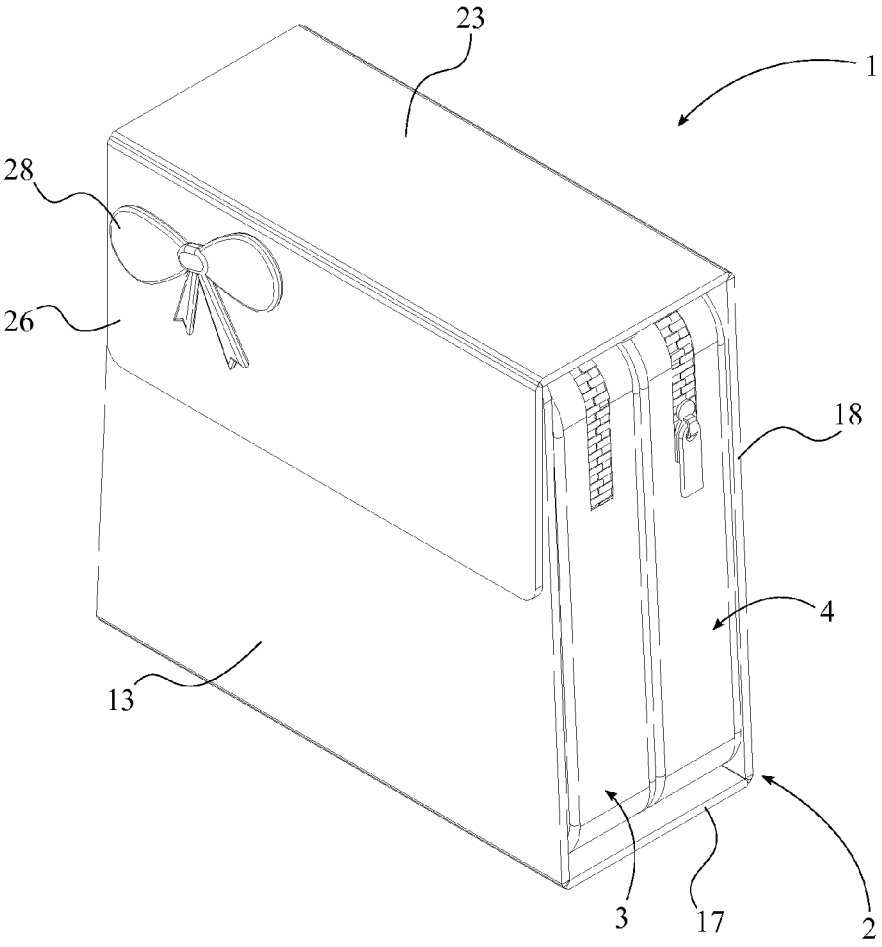
FIG. 3 is a perspective view of the present invention without a shoulder strap.

In reference to FIG. 1, FIG. 2, and FIG. 3, the present invention is an apparatus for a purse having interchangeable inner bags which comprises an outer casing 1, a plurality of inner bags 2, and a shoulder strap 5. Because of the plurality of inner bags 2 and the shoulder strap 5, the present invention provides a versatile purse which can convert between a cross over bag and a clutch bag. A first chosen bag 3 and a second chosen bag 4 of the plurality of inner bags 2 are removably attached to the outer casing 1, where the outer casing 1 encloses the first chosen bag 3 and the second chosen bag 4. Since the first chosen bag 3 and the second chosen bag 4 function as the interchangeable inner bags within the present invention, the users of the present invention are able to select the desired and relevant first chosen bag 3 and second chosen bag 4 from the plurality of inner bags 2 at any given time.

Figure 10:
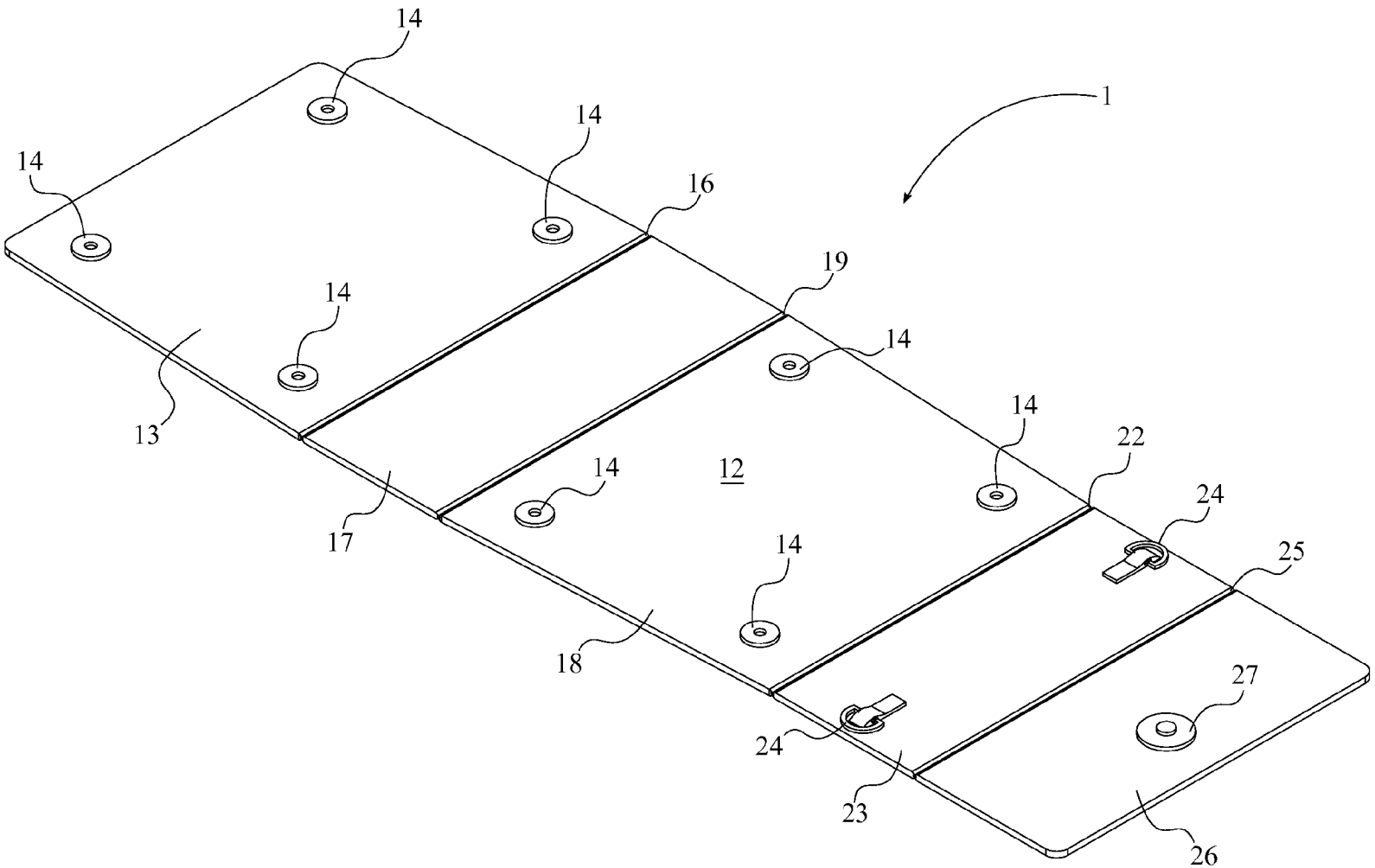
FIG. 10 is a perspective view of the outer casing of the present invention.
Figure 11:
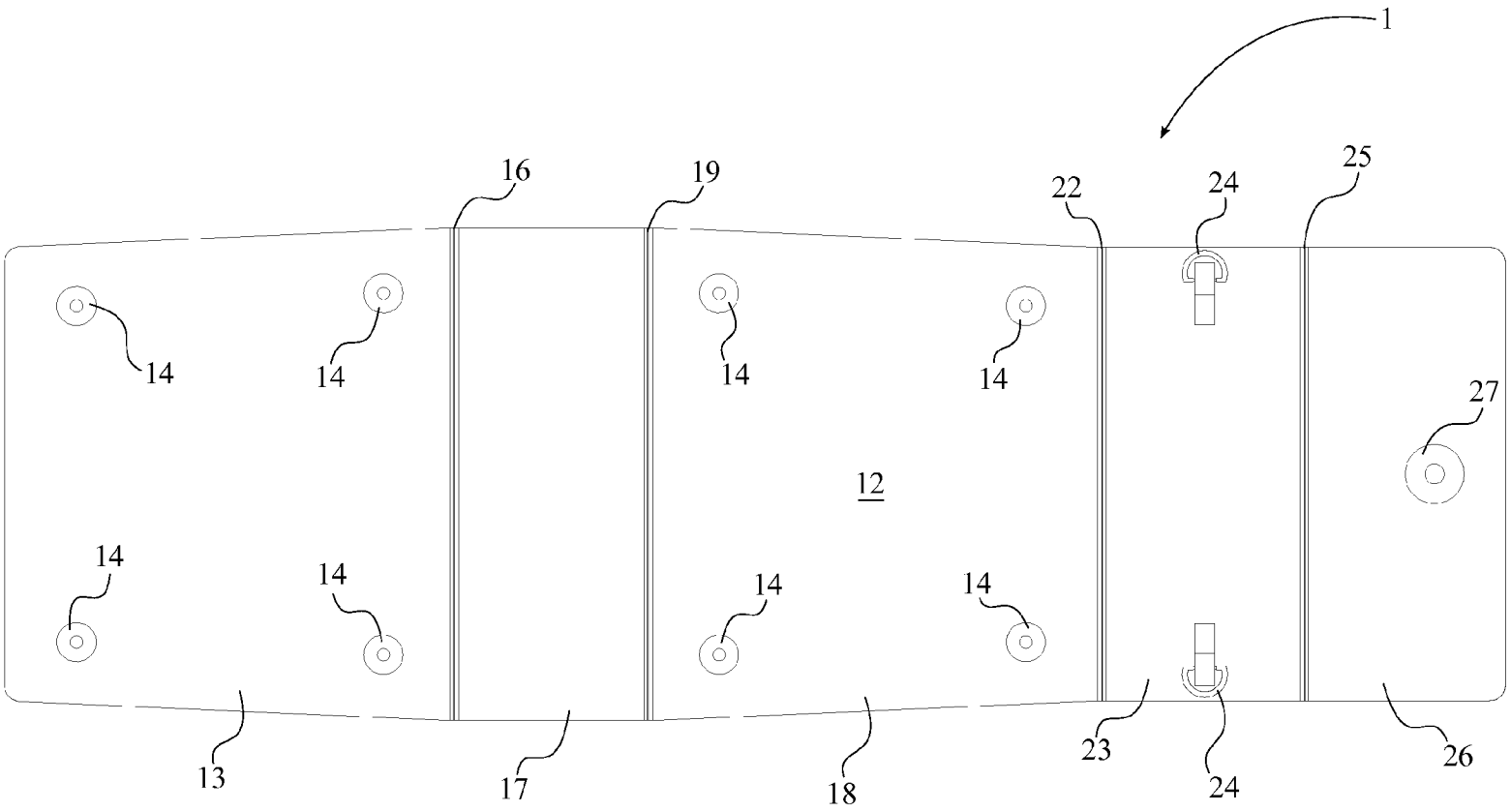
FIG. 11 is a top view of the outer casing of the present invention, showing an inner panel.
Figure 12:
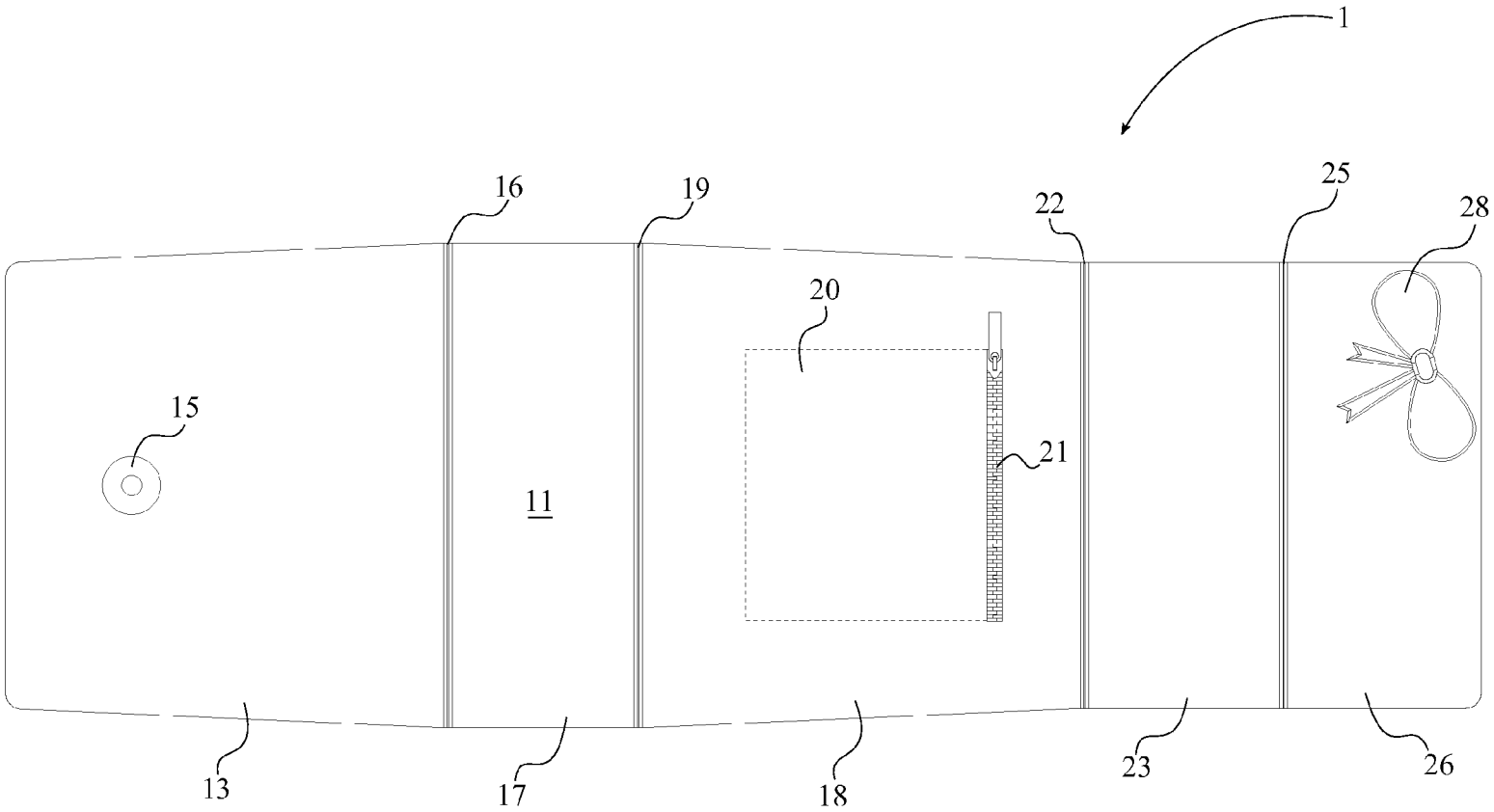
FIG. 12 is a bottom view of the outer casing of the present invention, showing an outer panel.
Figure 13:
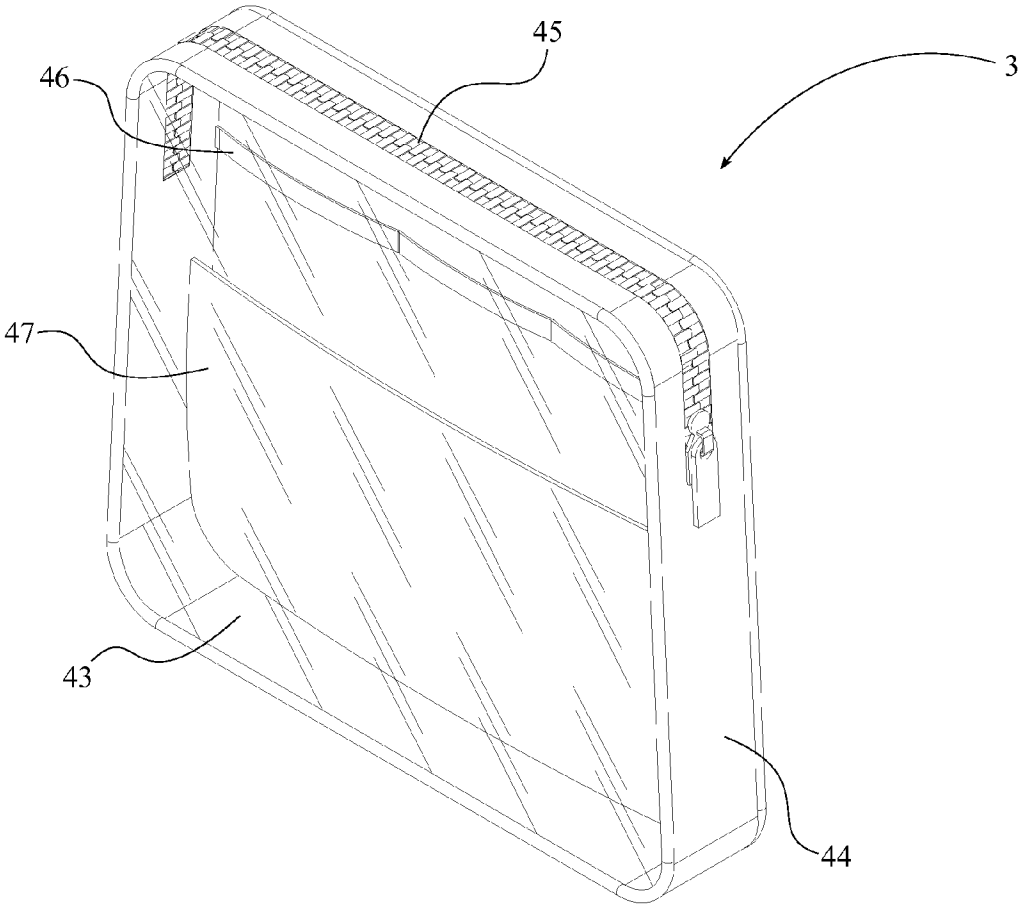
FIG. 13 is a perspective view of the inner bag of the present invention, wherein the inner bag is a first chosen bag.
Figure 14:
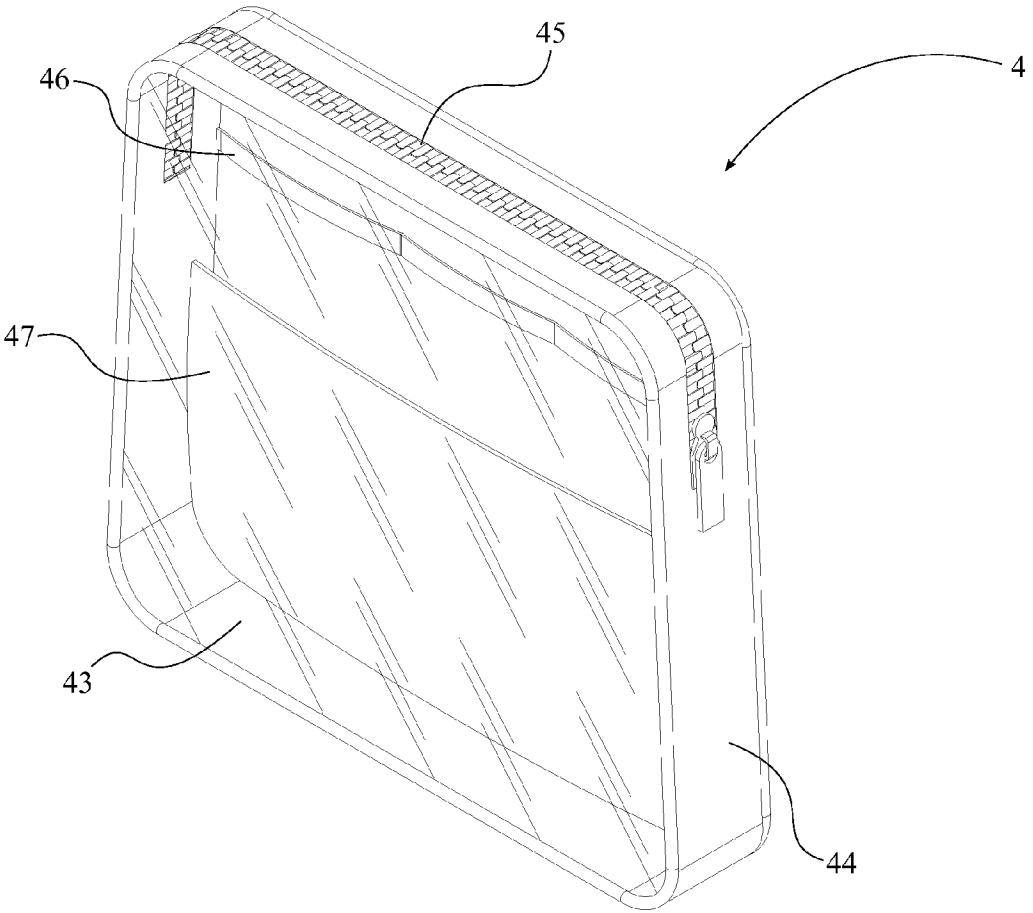
FIG. 14 is a perspective view of the inner bag of the present invention, wherein the inner bag is a second chosen bag.
Figure 15:
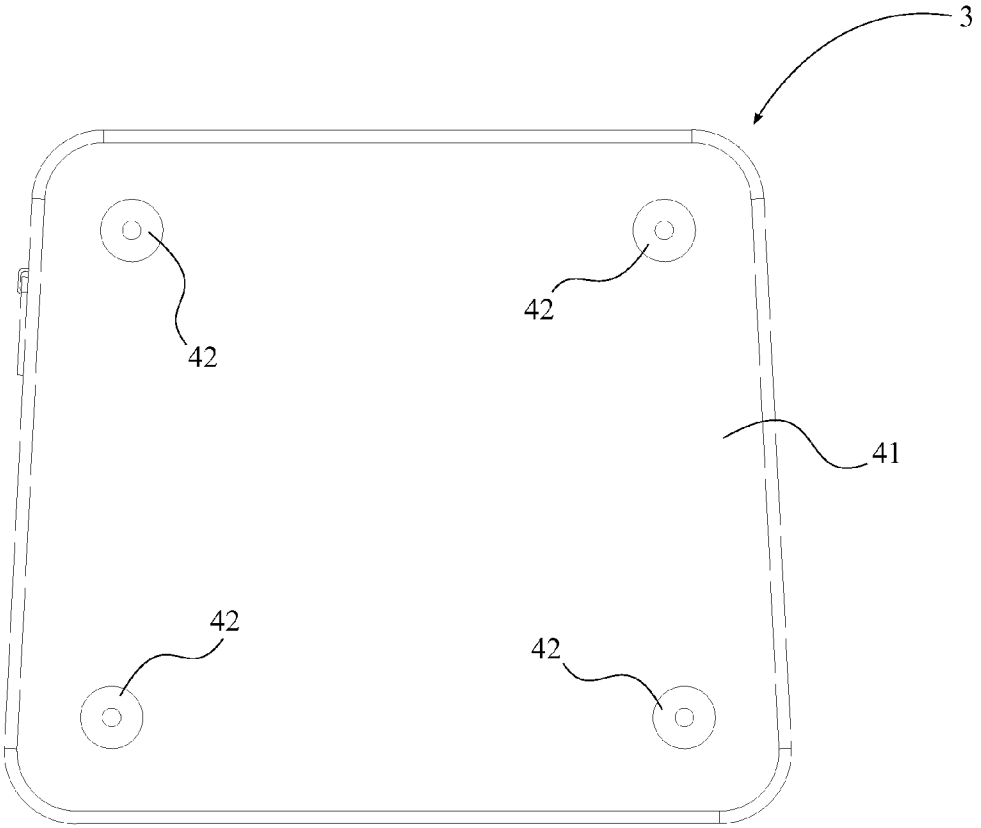
FIG. 15 is a back view of the first chosen bag of the present invention.
Figure 16:
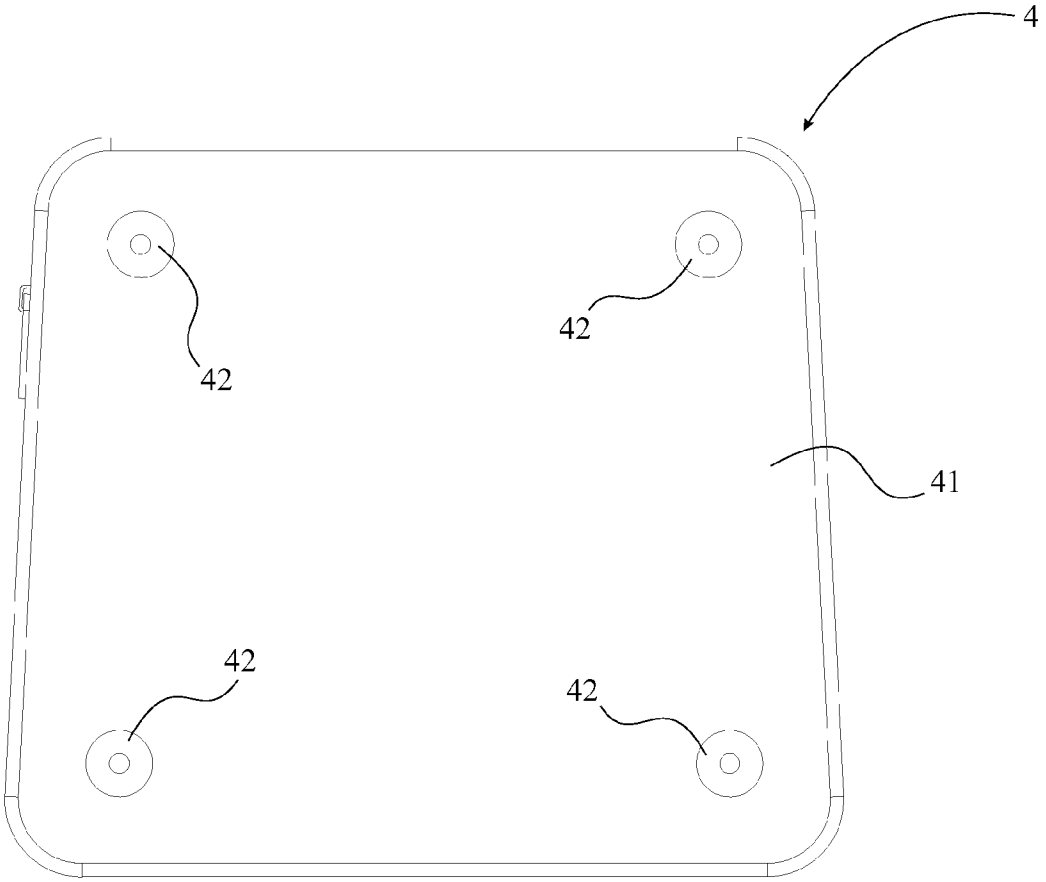
FIG. 16 is a back view of the second chosen bag of the present invention.

In reference to FIG. 10, FIG. 11, and FIG. 12, the outer casing 1 comprises an outer panel 11, an inner panel 12, a first bag connector section 13, a first bottom folding line 16, a bottom section 17, a second bottom folding line 19, a second bag connector section 18, a second top folding line 22, a top section 23, a first top folding line 25, a closing flap section 26, a male magnetic attachment 27, a plurality of female magnetic connections 14, an outer pocket 20, an outer zipper 21, a female magnetic attachment 15, and at least one ornamental member 28. The outer panel 11 and the inner panel 12 are connected to each other along the outer casing 1, where the outer panel 11 and the inner panel 12 extend throughout the outer casing 1. The outer casing 1 is divided into the first bag connector section 13, the bottom section 17, the second bag connector section 18, the top section 23, and the closing flap section 26 through the first bottom folding line 16, the second bottom folding line 19, the second top folding line 22, and the first top folding line 25. More specifically, the first bag connector section 13 is hingedly connected to the bottom section 17 with the first bottom folding line 16. The bottom section 17 is hingedly connected to the second bag connector section 18 with the second bottom folding line 19. The second bag connector section 18 is hingedly connected to the top section 23 with the second top folding line 22. The top section 23 is hingedly connected to the closing flap section 26 with the first top folding line 25. The outer casing 1 further comprises rigid panels in between the outer panel 11 and the inner panel 12 of the first bag connector section 13, the second bag connector section 18, and the closing flap section 26 so that the first bag connector section 13, the second bag connector section 18, and the closing flap section 26 are able to retain their shapes within the outer casing 1. Since the rigid panels are not positioned within the bottom section 17 and the top section 23, the outer panel 11 and the inner panel 12 of the bottom section 17 and the top section 23 are able to flex within the outer casing 1.

Figure 8:
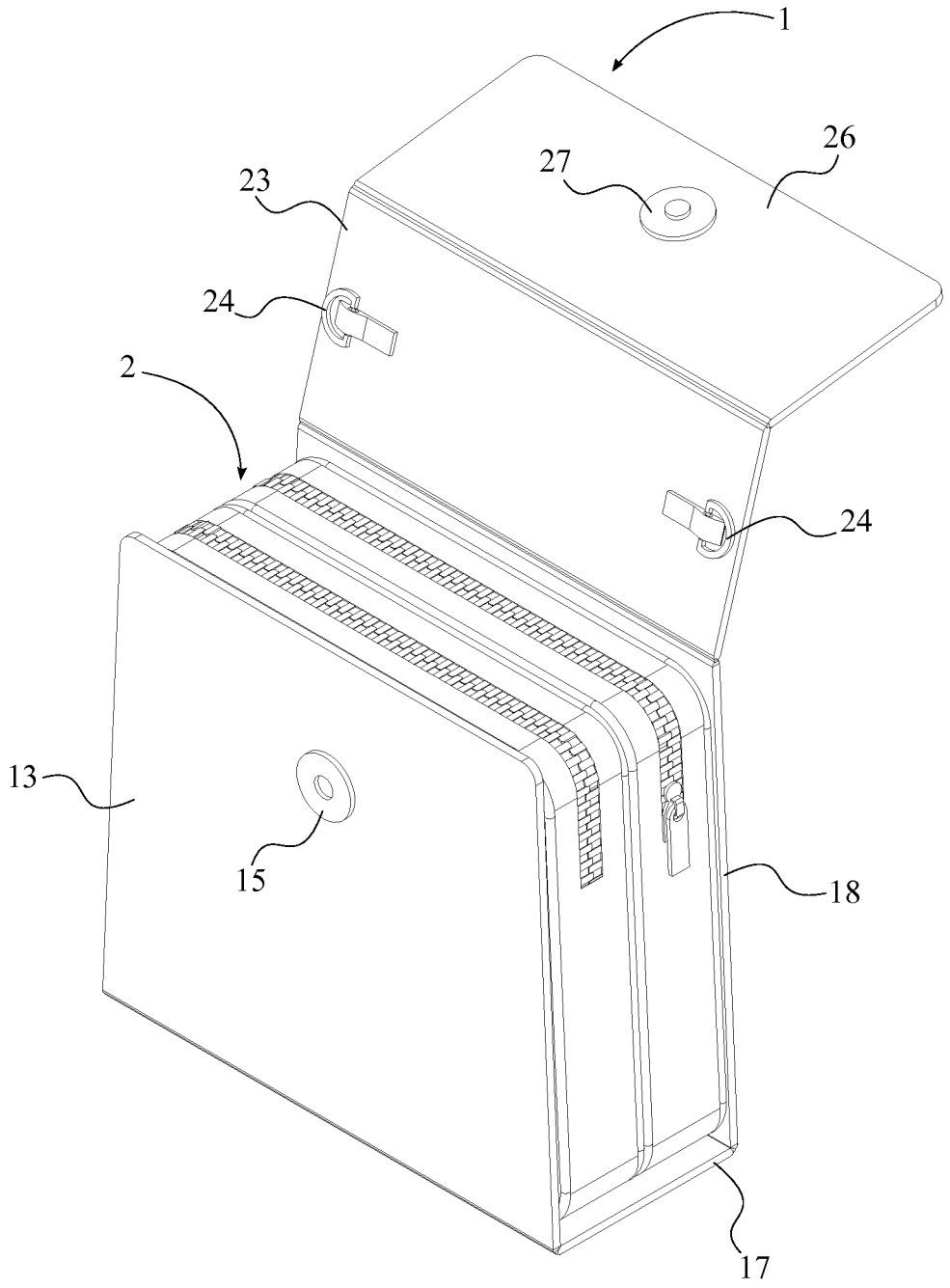
FIG. 8 is a perspective view of the present invention without the shoulder strap, wherein the closing flap section and a top section are opened.

In reference to FIG. 8 and FIG. 10, the top section 23 comprises a pair of connecting rings 24, where the pair of connecting rings 24 is adjacently connected with the inner panel 12 of the top section 23. More specifically, the pair of connecting rings 24 are oppositely positioned from each other and linearly positioned in between the second top folding line 22 and the first top folding line 25. The pair of connecting rings 24 can include, but is not limited to, D-rings, O-rings, square-rings, and diamond-rings. The positioning of the pair of connecting rings 24 does not extend out from extremities of the top section 23 in such a way that the pair of connecting rings 24 is completely unnoticeable from the outer panel 11 of the top section 23. As shown in FIG. 1 and FIG. 2, the shoulder strap 5 is removably attached with the pair of connecting rings 24, where the pair of connecting rings 24 functions as connection members for the shoulder strap 5. The shoulder strap 5 is completed with a pair of snap hooks at each extremity of the shoulder strap 5, where the pair of snap hooks attaches the shoulder strap 5 with the pair of connecting rings 24. The shoulder strap 5 of the present invention transforms the present invention from a clutch bag to a cross over bag. For example, when the present invention is used as the cross over bag, the shoulder strap 5 is attached with the pair of connecting rings 24 through the pair of snap hooks. When the present invention is used as the clutch bag, the shoulder strap 5 is detached from the pair of connecting rings 24. The male magnetic attachment 27 is connected onto the closing flap section 26, where the male magnetic attachment 27 is adjacently positioned with the inner panel 12. The plurality of female magnetic connections 14 is connected on the inner panel 12. More specifically, the plurality of female magnetic connections 14 is perimetrically positioned around the first bag connector section 13 and the second bag connector section 18.

Figure 4:
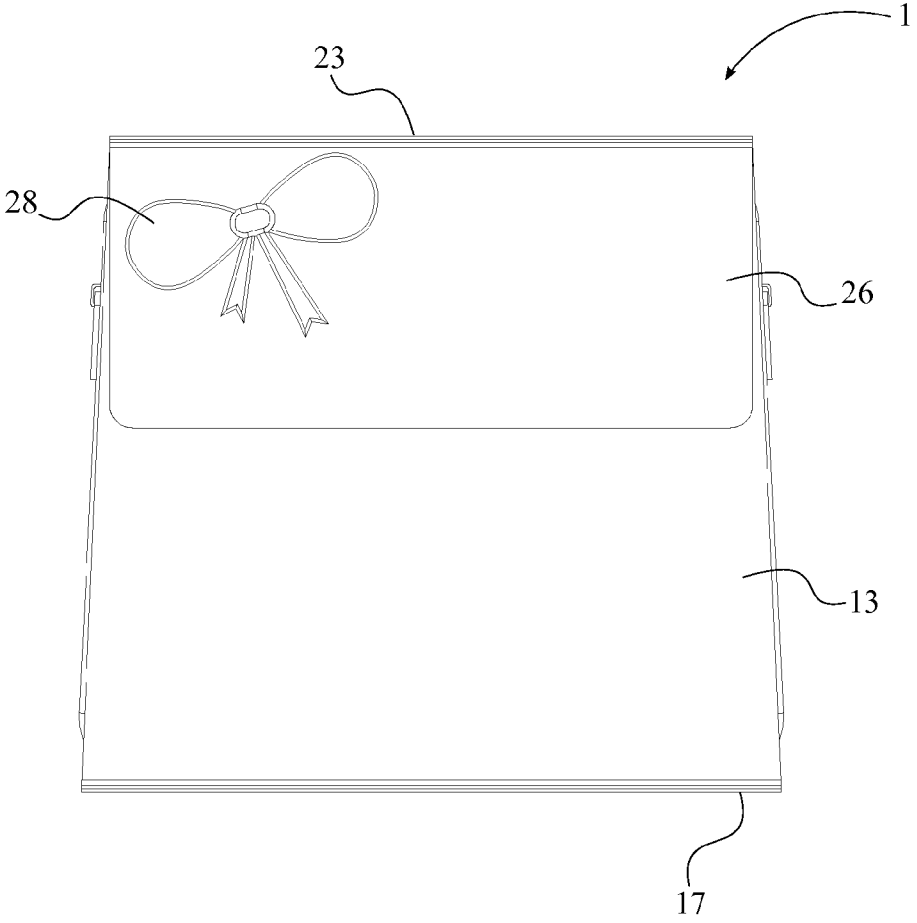
FIG. 4 is a front view of the present invention without the shoulder strap.
Figure 5:
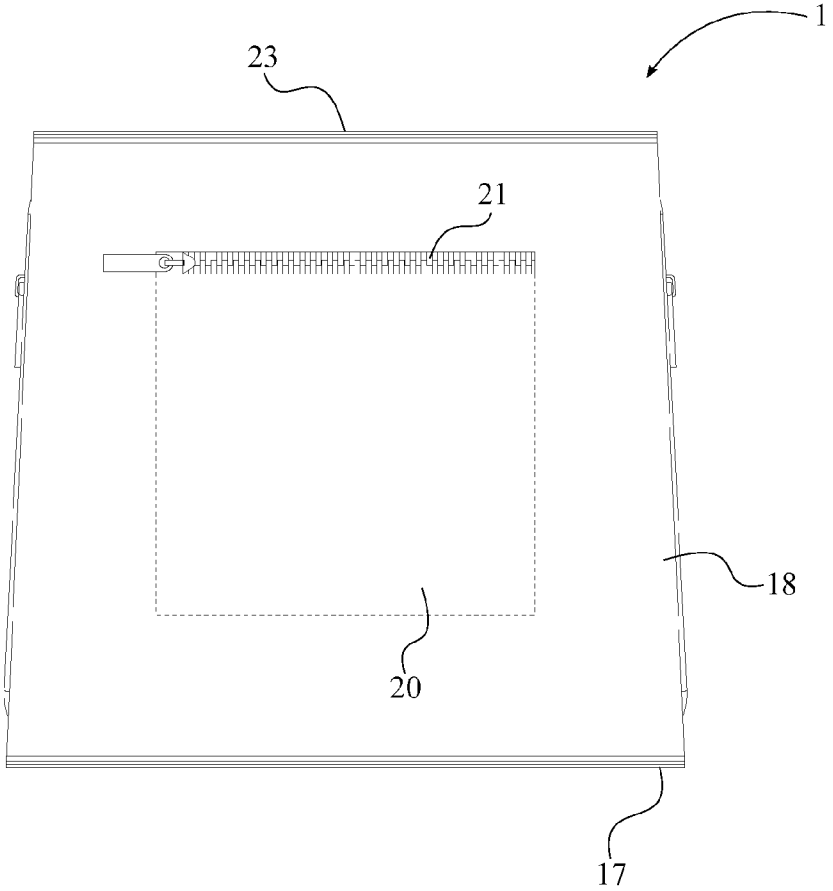
FIG. 5 is a back view of the present invention without the shoulder strap.

The female magnetic attachment 15 is adjacently connected with the outer panel 11, where the female magnetic attachment 15 is positioned on the first bag connector section 13. The outer pocket 20 is adjacently connected behind the outer panel 11 and positioned within the second bag connector section 18. As shown in FIG. 5 and FIG. 12, the outer zipper 21 is connected on the outer panel 11 and positioned adjacent with the outer pocket 20 so that the outer zipper 21 is able to provide an opening for the outer pocket 20. The users of the present invention can access the outer pocket 20 through the outer zipper 21 when the outer zipper 21 is opened. When the outer zipper 21 is closed, the stored items within the outer pocket 20 are completely secured by the outer zipper 21. The at least one ornamental member 28 is connected with the outer panel 11 since the outer panel 11 is visible to the surrounding environment. In reference to FIG. 4 and FIG. 12, the at least one ornamental member 28 is preferably positioned on the closing flap section 26 but may also be positioned on the top section 23, the bottom section 17, the first bag connector section 13, and the second bag connector section 18. The at least one ornamental member 28 provides an aesthetically pleasing appearance for the present invention, where the at least one ornamental member 28 can be, but not limited to, a decorative bow, designed logo, and decorative flower.

In reference to FIG. 13-FIG. 16, each of the plurality of inner bags 2 comprises a back panel 41, a plurality of male magnetic connections 42, a front transparent panel 43, a lateral panel 44, a bag zipper 45, an elastic band 46, and an inner pocket panel 47. The back panel 41 and the front transparent panel 43 are adjacently connected with the lateral panel 44, where the back panel 41 and the front transparent panel 43 are oppositely positioned from each other. The back panel 41, the front transparent panel 43, and the lateral panel 44 complete the overall shape for each of the plurality of inner bags 2. The bag zipper 45 is connected with the lateral panel 44 in a way that the bag zipper 45 is centrally positioned on lateral panel 44 in between the back panel 41 and the front transparent panel 43. More specifically, the bag zipper 45 is positioned along a top portion of the lateral panel 44 and extends into side portions of the lateral panel 44 providing the maximum opening for each of the plurality of inner bags 2. The bag zipper 45 provides access to the inside of each of the plurality of inner bags 2 so that the users of the present invention can easily access each of the plurality of inner bags 2. The elastic band 46 is connected along the back panel 41 within each of the plurality of inner bags 2, where the elastic band 46 is adjacently positioned with the bag zipper 45. The elastic band 46 is preferably connected with the back panel 41 in four different connection points creating three different parts within the elastic band 46 so that the elastic band 46 is able to individually function within each part without affecting the adjacent parts or part. The inner pocket panel 47 is connected to the back panel 41 within each of the plurality of inner bags 2, where the inner pocket panel 47 is adjacently positioned with the elastic band 46 opposite from the bag zipper 45. The inner pocket panel 47 and the back panel 41 create a pouch in between them so that items can be stored within each of the plurality of inner bags 2. The users of the present invention can open each of the plurality of inner bags 2 through the bag zipper 45 and store items in upright position, where the items are inserted through back panel 41 and the elastic band 46 and into the pouch. The elastic band 46 provides a snug fit for the stored items so that the stored items do not move within the pouch. Because of the front transparent panel 43, the users of the present invention are able to clearly see the full frontal view of the stored items through the front transparent panel 43. The visibility of the stored items within each of the plurality of inner bags 2 provides clear indication to the users what items have been stored within so that the users don't have to sort through the plurality of inner bags 2 to find a specific item. The plurality of male magnetic connections 42 is perimetrically and externally connected around the back panel 41, where the plurality of male magnetic connections 42 is oppositely positioned from the elastic band 46 and the inner pocket panel 47.

Figure 9:
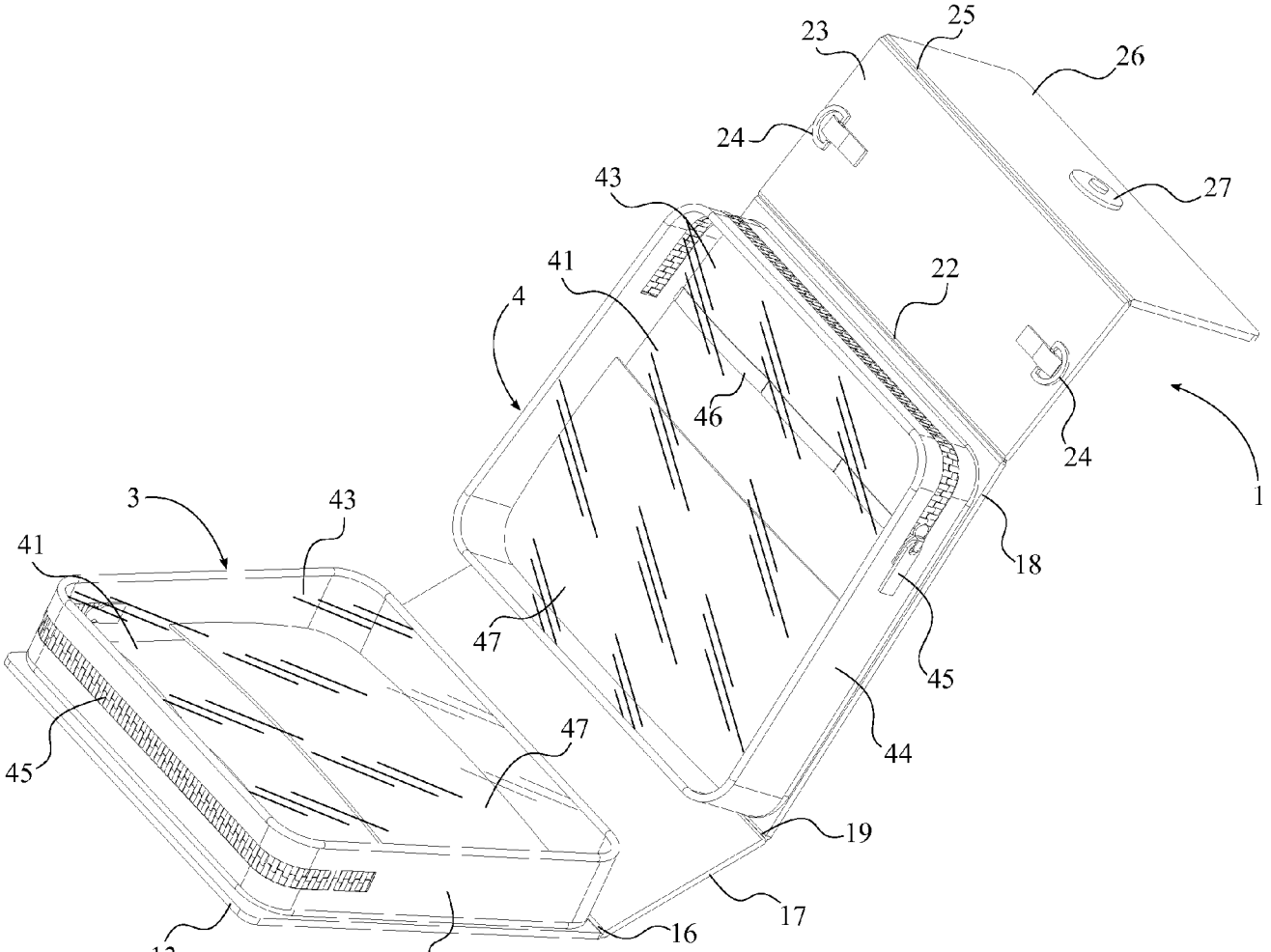
FIG. 9 is a perspective view of the present invention without the shoulder strap, wherein the outer casing is fully opened.
Figure 17:
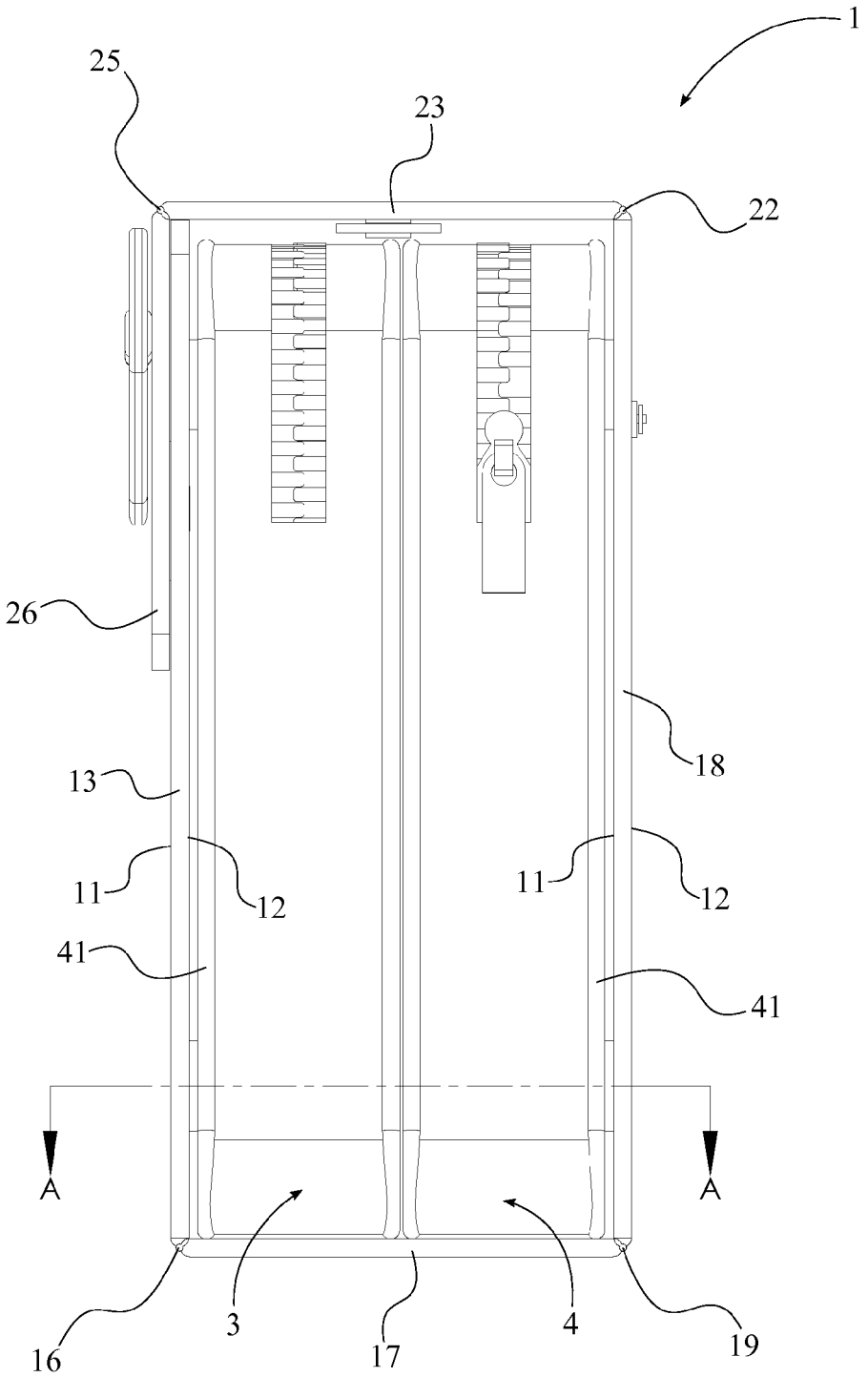
FIG. 17 is a side view of the present invention without the shoulder strap, showing a plane upon which a cross sectional view is taken shown in FIG. 18.
Figure 18:
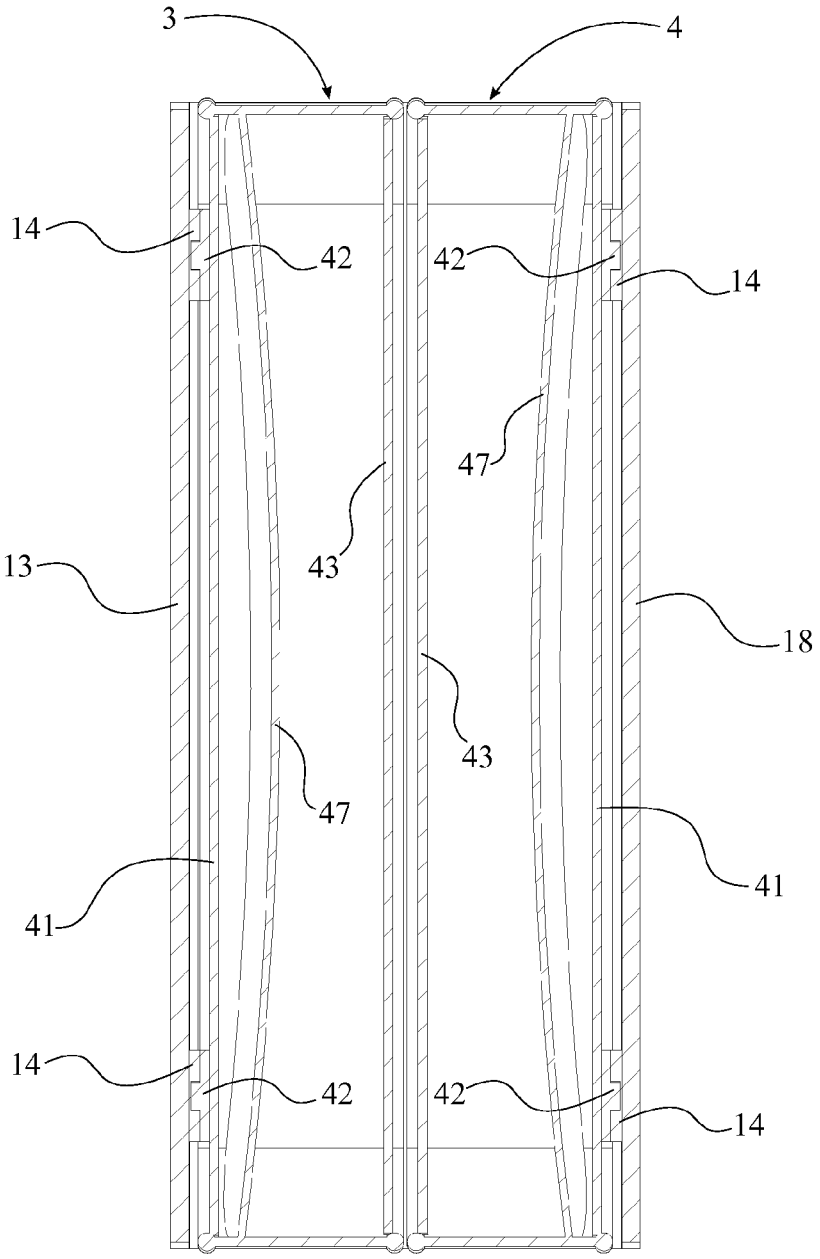
FIG. 18 is a cross sectional view of the present invention without the shoulder strap taken along the line A-A of FIG. 17.

In reference to FIG. 9, FIG. 17 and FIG. 18, since the first chosen bag 3 and the second chosen bag 4 are removably attached with the outer casing 1 and interchangeable within the present invention, users can select and attach the desired first chosen bag 3 and second chosen bag 4 from the plurality of inner bags 2. More specifically, the plurality of male magnetic connections 42 of the first chosen bag 3 is removably attached with the plurality of female magnetic connections 14 of the first bag connector section 13 due to the opposite magnetic attraction of the plurality of male magnetic connections 42 and the plurality of female magnetic connections 14. Once the first chosen bag 3 is attached with the first bag connector section 13, the back panel 41 of the first chosen bag 3 is adjacently positioned with the inner panel 12 of the first bag connector section 13 and the first bottom folding line 16. The plurality of male magnetic connections 42 of the second chosen bag 4 is removably attached with the plurality of female magnetic connections 14 of the second bag connector section 18 due to the opposite magnetic attraction of the plurality of male magnetic connections 42 and the plurality of female magnetic connections 14. Once the second chosen bag 4 is attached with the second bag connector section 18, the back panel 41 of the second chosen bag 4 is adjacently positioned with the inner panel 12 of the second bag connector section 18 and in between the second bottom folding line 19 and the second top folding line 22. Both the first chosen bag 3 and the second chosen bag 4 are attached to the outer casing 1 in such way that the top portion of the first chosen bag 3 and the top portion of the second chosen bag 4 are oppositely positioned from the bottom section 17. Each of the plurality of male magnetic connections 42 is concentrically traversed into each of the plurality of female magnetic connections 14 firmly attaching both the first chosen bag 3 and the second chosen bag 4 to the outer casing 1. Due to the magnetic connection between the plurality of inner bags 2 and the outer casing 1, the users of the present invention can interchange the plurality of inner bags 2 efficiently and effortlessly.

Figure 6:
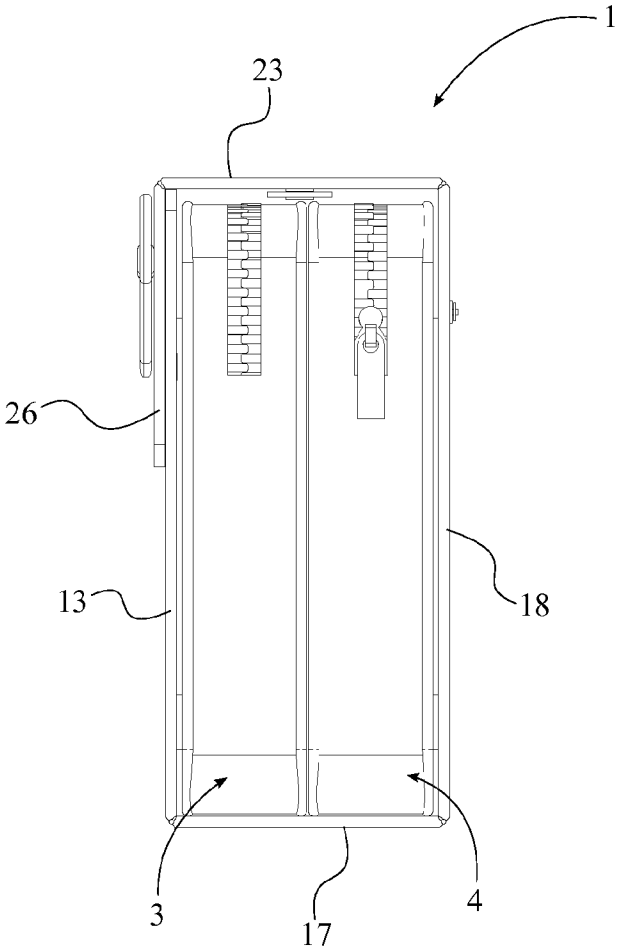
FIG. 6 is a side view of the present invention without the shoulder strap.
Figure 7:
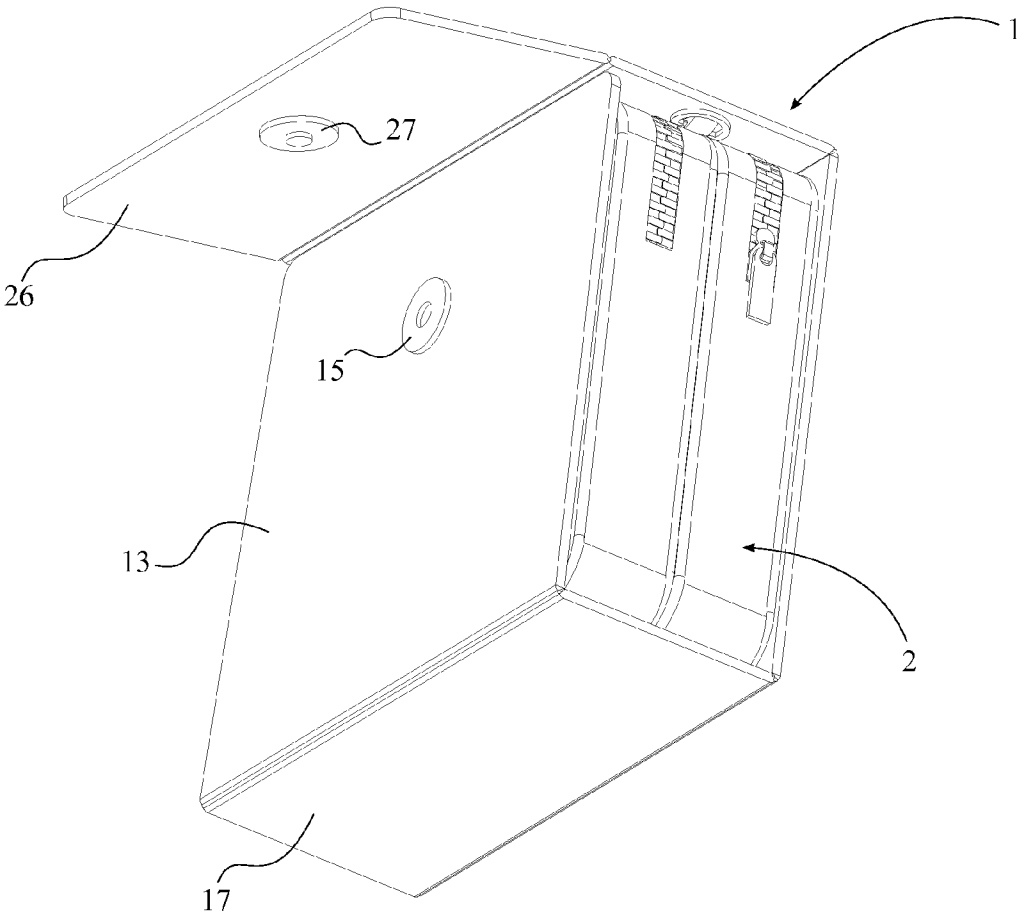
FIG. 7 is a bottom perspective view of the present invention without the shoulder strap, wherein a closing flap section is opened.

In reference to FIG. 6 and FIG. 7, once the first chosen bag 3 and the second chosen bag 4 are placed within the outer casing 1, the outer casing 1 is folded from the first bottom folding line 16, the second bottom folding line 19, the first top folding line 25, and the second top folding line 22 so that the outer casing 1 can securely enclose the first chosen bag 3 and the second chosen bag 4 within. The first bag connector section 13 and the second bag connector section 18 are folded parallel to each other through the first bottom folding line 16 and the second bottom folding line 19 in such way that the front transparent panel 43 and the bag zipper 45 of the first chosen bag 3 and the second chosen bag 4 are adjacently positioned with each other. The top section 23 is folded over the first chosen bag 3 and the second chosen bag 4 through the second top folding line 22, and the closing flap section 26 is folded over the outer panel 11 of the first bag connector section 13 through the first top folding line 25. The closing flap section 26 is removably attached with the first bag connector section 13 enclosing the first chosen bag 3 and the second chosen bag 4. More specifically, the male magnetic attachment 27 is removably attached with the female magnetic attachment 15 due to the opposite magnetic attraction of the male magnetic attachment 27 and the female magnetic attachment 15, where the male magnetic attachment 27 is traversed into the female magnetic attachment 15.

In reference to FIG. 7, FIG. 8, and FIG. 9, when the users of the present invention need to access or change the first chosen bag 3 or the second chosen bag 4, the users need to detach the closing flap section 26 from the first bag connector section 13 which opens up the top section 23 by unfolding around the second top folding line 22. Then the first chosen bag 3 or the second chosen bag 4 can be accessed or changed since the first bag connector section 13 and the second bag connector section 18 create the necessary space by respectively unfolding around the first bottom folding line 16 and the second bottom folding line 19.

Although the invention has been explained in relation to its preferred embodiment, it is to be understood that many other possible modifications and variations can be made without departing from the spirit and scope of the invention as hereinafter claimed.

What is claimed is:

1. An apparatus for a purse having interchangeable inner bags comprises:

an outer casing;

a plurality of inner bags;

a shoulder strap;

the outer casing comprises an outer surface, an inner surface, a first bag connector section, a first bottom folding line, a bottom section, a second bottom folding line, a second bag connector section, a second top folding line, a top section, a first top folding line, a closing flap section, a male magnetic attachment, a plurality of female magnetic connections, an outer pocket, an outer zipper, a female magnetic attachment, and at least one ornamental member;

each of the plurality of inner bags comprises a back panel, a plurality of male magnetic connections, a front transparent panel, a lateral panel, a bag zipper, an elastic band, and an inner pocket panel;

the plurality of inner bags comprises a first chosen bag and a second chosen bag;

the first chosen bag and the second chosen bag being removably attached to the outer casing;

the outer casing being enclosed around the first chosen bag and the second chosen bag;

the first chosen bag and second chosen bag being attached to the outer surface;

a top portion of the first chosen bag and a top portion of the second chosen bag are oppositely positioned;

each of the plurality of male magnetic connections being concentrically traversed into each of the plurality of female connections;

the top section comprises a pair of connecting rings;

the pair of connecting rings being adjacently connected with the inner surface;

the pair of connecting rings being oppositely positioned from each other;

the pair of connecting rings being linearly positioned in between the second top folding line and the first top folding line;

the shoulder strap being removably attached with the pair of connecting rings;

the male magnetic attachment being connected on the closing flap section;

the male magnetic attachment being adjacently positioned with the inner surface;

the connecting rings being D-rings;

the shoulder strap comprises a first and second snap hook oppositely positioned at a first and second extremity of the shoulder strap, wherein the first and second of snap hooks are attached to the shoulder strap by a first and second connecting ring, respectively;

the back panel and the front transparent panel being adjacently connected with the lateral panel;

the back panel being oppositely positioned from the front transparent panel;

the bag zipper being connected with the lateral panel;

the bag zipper being centrally positioned on the lateral panel in between the back panel and the front transparent panel;

the elastic band being connected along the back panel in four connection points within each of the plurality of inner bags;

the elastic band being adjacently positioned with the bag zipper;

the inner pocket panel being connected to the back panel within each of the plurality of inner bags;

the inner pocket panel being adjacently positioned with the elastic band opposite from the bag zipper;

the plurality of male magnetic connections being perimetrically connected around the back panel;

the plurality of male magnetic connections being oppositely positioned from the elastic band and the inner pocket panel;

the bag zipper being positioned along a top portion of the lateral panel and extending into side portions of the lateral panel;

the inner pocked panel and the back panel forming a pouch;

the plurality of male magnetic connections of the first chosen bag being removably attached with the plurality of female magnetic connections of the first bag connector section;

the back panel of the first chosen bag being adjacently positioned with the inner surface of the first bag connector section and the first bottom folding line;

the plurality of male magnetic connections of the second chosen bag being removably attached with the plurality of female magnetic connections of the second bag connector section;

the back panel of the second chosen bag being adjacently positioned with the inner surface of the second bag connector section and in between the second bottom folding line and the second top folding line;

the first bag connector section and the second bag connector section being folded parallel to each other through the first bottom folding line and the second bottom folding line;

the front transparent panel of the first chosen bag and the second chosen bag being adjacently positioned with each other;

the top section being folded over the first chosen bag and the second chosen bag through the second top folding line;

the closing flap section being folded over the outer surface of the first bag connector section through the first top folding line;

the closing flap section enclosing the first chosen bag and the second chosen bag; and the male magnetic attachment being removably attached with the female magnetic attachment.

2. The apparatus for a purse having interchangeable inner bags as claimed in claim 1 comprises:

the outer surface and the inner surface being connected to each other along the outer casing;

the first bag connector section being hingedly connected to the bottom section with the first bottom folding line;

the bottom section being hingedly connected to the second bag connector section with the second bottom folding line;

the second bag connector section being hingedly connected to the top section with the second top folding line; and the top section being hingedly connected to the closing flap section with the first top folding line.

3. The apparatus for a purse having interchangeable inner bags as claimed in claim 1 comprises:

the plurality of female magnetic connections being connected on the inner surface;

the plurality of female magnetic connections being perimetrically positioned around the first bag connector section; and the plurality of female magnetic connections being perimetrically positioned around the second bag connector section.

4. The apparatus for a purse having interchangeable inner bags as claimed in claim 1 comprises:

the female magnetic attachment being adjacently connected with the outer surface;

the female magnetic attachment being positioned on the first bag connector section;

the outer pocket being adjacently connected behind the outer surface;

the outer pocket being positioned within the second bag connector section;

the outer zipper being connected on the outer surface;

the outer zipper being adjacently positioned with the outer pocket, wherein the outer zipper provides an opening for the outer pocket;

the at least one ornamental member being connected with the outer surface; and the at least one ornamental member being positioned on the closing flap section.

5. An apparatus for a purse having interchangeable inner bags comprises:

an outer casing;

a plurality of inner bags;

a shoulder strap;

the outer casing comprises an outer surface, an inner surface, a first bag connector section, a first bottom folding line, a bottom section, a second bottom folding line, a second bag connector section, a second top folding line, a top section, a first top folding line, a closing flap section, a male magnetic attachment, a plurality of female magnetic connections, an outer pocket, an outer zipper, a female magnetic attachment, and at least one ornamental member;

each of the plurality of inner bags comprises a back panel, a plurality of male magnetic connections, a front transparent panel, a lateral panel, a bag zipper, an elastic band, and an inner pocket panel;

the plurality of inner bags comprises a first chosen bag and a second chosen bag;

the first chosen bag and the second chosen bag being removably attached to the outer casing;

the outer casing being enclosed around the first chosen bag and the second chosen bag;

the first chosen bag and second chosen bag being attached to the outer surface;

a top portion of the first chosen bag and a top portion of the second chosen bag are oppositely positioned;

each of the plurality of male magnetic connections being concentrically traversed into each of the plurality of female connections;

the outer surface and the inner surface being connected to each other along the outer casing;

the first bag connector section being hingedly connected to the bottom section with the first bottom folding line;

the bottom section being hingedly connected to the second bag connector section with the second bottom folding line;

the second bag connector section being hingedly connected to the top section with the second top folding line;

the top section being hingedly connected to the closing flap section with the first top folding line;

the pair of connecting rings being adjacently connected with the inner surface;

the pair of connecting rings being oppositely positioned from each other;

the pair of connecting rings being linearly positioned in between the second top folding line and the first top folding line;

the male magnetic attachment being connected on the closing flap section;

the male magnetic attachment being adjacently positioned with the inner surface;

the connecting rings being D-rings;

the shoulder strap comprises a first and second snap hook oppositely positioned at a first and second extremity of the shoulder strap, wherein the first and second of snap hooks are attached to the shoulder strap by a first and second connecting ring, respectively;

the back panel and the front transparent panel being adjacently connected with the lateral panel;

the back panel being oppositely positioned from the front transparent panel;

the bag zipper being connected with the lateral panel;

the bag zipper being centrally positioned on the lateral panel in between the back panel and the front transparent panel;

the elastic band being connected along the back panel in four connection points within each of the plurality of inner bags;

the elastic band being adjacently positioned with the bag zipper;

the inner pocket panel being connected to the back panel within each of the plurality of inner bags;

the inner pocket panel being adjacently positioned with the elastic band opposite from the bag zipper;

the plurality of male magnetic connections being perimetrically connected around the back panel;

the plurality of male magnetic connections being oppositely positioned from the elastic band and the inner pocket panel;

the bag zipper being positioned along a top portion of the lateral panel and extending into side portions of the lateral panel;

the inner pocked panel and the back panel forming a pouch;

the plurality of male magnetic connections of the first chosen bag being removably attached with the plurality of female magnetic connections of the first bag connector section;

the back panel of the first chosen bag being adjacently positioned with the inner surface of the first bag connector section and the first bottom folding line;

the plurality of male magnetic connections of the second chosen bag being removably attached with the plurality of female magnetic connections of the second bag connector section;

the back panel of the second chosen bag being adjacently positioned with the inner surface of the second bag connector section and in between the second bottom folding line and the second top folding line;

the first bag connector section and the second bag connector section being folded parallel to each other through the first bottom folding line and the second bottom folding line;

the front transparent panel of the first chosen bag and the second chosen bag being adjacently positioned with each other;

the top section being folded over the first chosen bag and the second chosen bag through the second top folding line;

the closing flap section being folded over the outer surface of the first bag connector section through the first top folding line; and the closing flap section enclosing the first chosen bag and the second chosen bag;

the male magnetic attachment being removably attached with the female magnetic attachment.

6. The apparatus for a purse having interchangeable inner bags as claimed in claim 5 comprises:

the plurality of female magnetic connections being connected on the inner surface;

the plurality of female magnetic connections being perimetrically positioned around the first bag connector section; and the plurality of female magnetic connections being perimetrically positioned around the second bag connector section.

7. The apparatus for a purse having interchangeable inner bags as claimed in claim 5 comprises:

the female magnetic attachment being adjacently connected with the outer surface;

the female magnetic attachment being positioned on the first bag connector section;

the outer pocket being adjacently connected behind the outer surface;

the outer pocket being positioned within the second bag connector section;

the outer zipper being connected on the outer surface;

the outer zipper being adjacently positioned with the outer pocket, wherein the outer zipper provides an opening for the outer pocket;

the at least one ornamental member being connected with the outer surface; and the at least one ornamental member being positioned on the closing flap section.

8. An apparatus for a purse having interchangeable inner bags comprises:

an outer casing;

a plurality of inner bags;

a shoulder strap;

the outer casing comprises an outer surface, an inner surface, a first bag connector section, a first bottom folding line, a bottom section, a second bottom folding line, a second bag connector section, a second top folding line, a top section, a first top folding line, a closing flap section, a male magnetic attachment, a plurality of female magnetic connections, an outer pocket, an outer zipper, a female magnetic attachment, and at least one ornamental member;

each of the plurality of inner bags comprises a back panel, a plurality of male magnetic connections, a front transparent panel, a lateral panel, a bag zipper, an elastic band, and an inner pocket panel;

the plurality of inner bags comprises a first chosen bag and a second chosen bag;

the first chosen bag and the second chosen bag being removably attached to the outer casing;

the outer casing being enclosed around the first chosen bag and the second chosen bag;

the first chosen bag and second chosen bag being attached to the outer surface;

a top portion of the first chosen bag and a top portion of the second chosen bag are oppositely positioned;

each of the plurality of male magnetic connections being concentrically traversed into each of the plurality of female connections;

the outer surface and the inner surface being connected to each other along the outer casing;

the first bag connector section being hingedly connected to the bottom section with the first bottom folding line;

the bottom section being hingedly connected to the second bag connector section with the second bottom folding line;

the second bag connector section being hingedly connected to the top section with the second top folding line;

the top section being hingedly connected to the closing flap section with the first top folding line;

the top section comprises a pair of connecting rings;

the pair of connecting rings being adjacently connected with the inner surface;

the pair of connecting rings being oppositely positioned from each other;

the pair of connecting rings being linearly positioned in between the second top folding line and the first top folding line;

the shoulder strap being removably attached with the pair of connecting rings;

the male magnetic attachment being connected on the closing flap section;

the male magnetic attachment being adjacently positioned with the inner surface;

the connecting rings being D-rings;

the shoulder strap comprises a first and second snap hook oppositely positioned at a first and second extremity of the shoulder strap, wherein the first and second of snap hooks are attached to the shoulder strap by a first and second connecting ring, respectively;

the back panel and the front transparent panel being adjacently connected with the lateral panel;

the back panel being oppositely positioned from the front transparent panel;

the bag zipper being connected with the lateral panel;

the bag zipper being centrally positioned on the lateral panel in between the back panel and the front transparent panel;

the elastic band being connected along the back panel in four connection points within each of the plurality of inner bags;

the elastic band being adjacently positioned with the bag zipper;

the inner pocket panel being connected to the back panel within each of the plurality of inner bags;

the inner pocket panel being adjacently positioned with the elastic band opposite from the bag zipper;

the plurality of male magnetic connections being perimetrically connected around the back panel;

the plurality of male magnetic connections being oppositely positioned from the elastic band and the inner pocket panel;

the bag zipper being positioned along a top portion of the lateral panel and extending into side portions of the lateral panel;

the inner pocked panel and the back panel forming a pouch;

the plurality of male magnetic connections of the first chosen bag being removably attached with the plurality of female magnetic connections of the first bag connector section;

the back panel of the first chosen bag being adjacently positioned with the inner surface of the first bag connector section and the first bottom folding line;

the plurality of male magnetic connections of the second chosen bag being removably attached with the plurality of female magnetic connections of the second bag connector section;

the back panel of the second chosen bag being adjacently positioned with the inner surface of the second bag connector section and in between the second bottom folding line and the second top folding line;

the first bag connector section and the second bag connector section being folded parallel to each other through the first bottom folding line and the second bottom folding line;

the front transparent panel of the first chosen bag and the second chosen bag being adjacently positioned with each other;

the top section being folded over the first chosen bag and the second chosen bag through the second top folding line;

the closing flap section being folded over the outer surface of the first bag connector section through the first top folding line;

the closing flap section enclosing the first chosen bag and the second chosen bag; and the male magnetic attachment being removably attached with the female magnetic attachment.

9. The apparatus for a purse having interchangeable inner bags as claimed in claim 8 comprises:

the plurality of female magnetic connections being connected on the inner surface;

the plurality of female magnetic connections being perimetrically positioned around the first bag connector section; and the plurality of female magnetic connections being perimetrically positioned around the second bag connector section.

10. The apparatus for a purse having interchangeable inner bags as claimed in claim 8 comprises:

the female magnetic attachment being adjacently connected with the outer surface;

the female magnetic attachment being positioned on the first bag connector section;

the outer pocket being adjacently connected behind the outer surface;

the outer pocket being positioned within the second bag connector section;

the outer zipper being connected on the outer surface;

the outer zipper being adjacently positioned with the outer pocket, wherein the outer zipper provides an opening for the outer pocket;

the at least one ornamental member being connected with the outer surface; and the at least one ornamental member being positioned on the closing flap section.

* * * * *